US010796661B2

(12) United States Patent
Park

(10) Patent No.: US 10,796,661 B2
(45) Date of Patent: Oct. 6, 2020

(54) DISPLAY DRIVER INTEGRATED CIRCUIT WITH OPERATING FREQUENCY ADJUSTMENT AND METHOD OF ADJUSTING OPERATING FREQUENCY

(71) Applicant: MagnaChip Semiconductor, Ltd., Cheongju-si (KR)

(72) Inventor: Sang Su Park, Cheongju-si (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 16/571,731

(22) Filed: Sep. 16, 2019

(65) Prior Publication Data

US 2020/0118517 A1 Apr. 16, 2020

(30) Foreign Application Priority Data

Oct. 11, 2018 (KR) ..... 10-2018-0121065

(51) Int. Cl.
*G09G 5/00* (2006.01)

(52) U.S. Cl.
CPC ..... *G09G 5/006* (2013.01); *G09G 2310/0243* (2013.01); *G09G 2310/08* (2013.01); *G09G 2330/06* (2013.01); *G09G 2370/10* (2013.01)

(58) Field of Classification Search
CPC ..... G09G 5/006
USPC ..... 345/214
See application file for complete search history.

(56) References Cited

U.S. PATENT DOCUMENTS 8,981,858 B1 * 3/2015 Wright ..... H04B 15/06 331/78
9,479,113 B2 10/2016 Yamamoto et al.
2008/0100350 A1 * 5/2008 Pernia ..... H03B 5/1243 327/114

* cited by examiner

*Primary Examiner* — Calvin C Ma
(74) *Attorney, Agent, or Firm* — NSIP Law

(57) ABSTRACT

A display driver IC which adjusts an oscillator frequency is provided. The display driver IC includes: a register map which stores a trim code, a window size, compensation information, and a compensation option; an oscillator which generates an oscillator clock based on the trim code; a timing controller which generates an internal synchronization signal based on the oscillator clock; a DSI block which outputs a first data valid signal which is activated based on a data clock and image data packet update; and a frequency compensating block which compares a periodic value of the oscillator clock calculated based on the data clock and the internal synchronization signal with a target periodic value and generates a compensation trim code obtained by compensating the trim code based on the compensation option, in accordance with the first data valid signal.

26 Claims, 12 Drawing Sheets

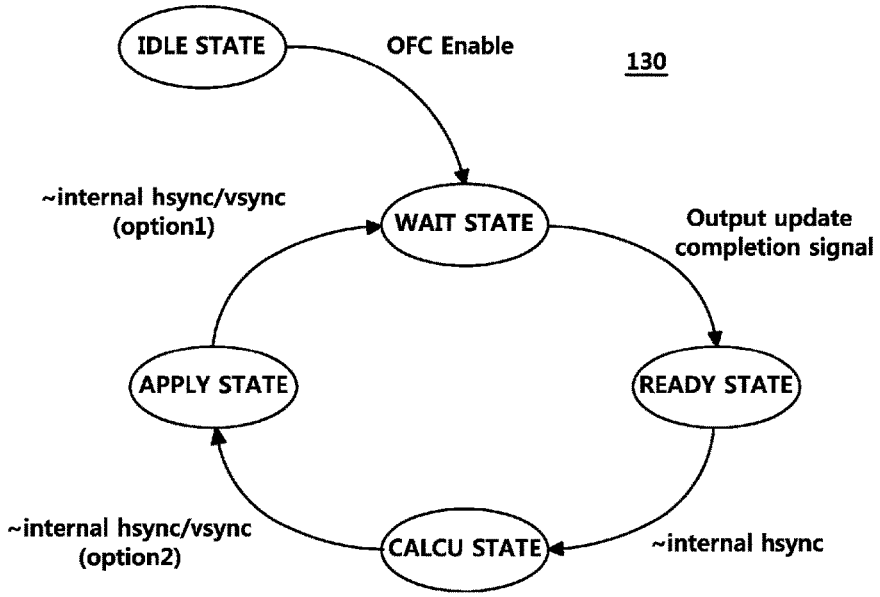

FIG. 4A

| WAIT STATE entering Option1 | APPLY STATE entering Option2 | Effect obtained by applying options 1 and 2 |
|---|---|---|
| 0<br>vsync synchronization | 0<br>vsync synchronization | Apply stabilization for one frame<br>compensation trim codes are not mixed for one frame |
| 0<br>vsync synchronization | 1<br>hsync synchronization | Apply stabilization for 1h or more<br>compensation trim codes may be mixed for one frame |
| 1<br>hsync synchronization | 0<br>vsync synchronization | Apply stabilization for 1h or more<br>compensation trim codes are not mixed for one frame |
| 1<br>hsync synchronization | 1<br>hsync synchronization | Apply stabilization for 1h<br>compensation trim codes may be mixed for one frame |

FIG. 4B

DISPLAY DRIVER INTEGRATED CIRCUIT WITH OPERATING FREQUENCY ADJUSTMENT AND METHOD OF ADJUSTING OPERATING FREQUENCY

CROSS-REFERENCE TO RELATED APPLICATION

This application claims the benefit under 35 U.S.C. 119(a) of Korean Patent Application No. 10-2018-0121065 filed on Oct. 11, 2018 in the Korean Intellectual Property Office, the entire disclosure of which is incorporated herein by reference for all purposes.

BACKGROUND

1. Field

The following description relates to a display driver Integrated Circuit (IC) with operating frequency adjustment, and a method of the operating frequency of an oscillator.

2. Description of Related Art

In order to maintain a frame frequency at the time of driving a display panel, a frequency that is fixed by applying a trim code received from a register to an oscillator may be used. However, when the temperature and voltage change, the characteristics of the oscillator are reflected as it is and the frequency of the oscillator may be changed, and may deviate from a target frequency. This deviation may affect the frame frequency.

It is desirable that mobile electronic devices consume low power, and be multi-functional, lighter, thinner, shorter, and smaller, in accordance with the demands of consumers. However, in modern electronic devices, many components have to be integrated in a small area in accordance with the demands of the consumers, and an operating frequency is increased to a high frequency band in accordance with the higher performance of the components.

As the frequency band of the operating frequency of components in the mobile electronic apparatus is increased, the mobile electronic apparatus becomes vulnerable to the electromagnetic interference (EMI) between components and noise generation, and thus a signal quality is deteriorated. For example, in the display driver IC, noise may be generated due to an electromagnetic interference (EMI) in an internal oscillator.

The internal oscillator of the display driver IC may select a specific frequency excluding several frequency bands used in a mobile electronic device, as an operating frequency. For example, the operating frequency may become a frame frequency of 60 Hz using an oscillator clock of an operating frequency when the display panel is driven.

However, when a frequency fixed by applying a trim code received from a register is used for the oscillator, a multiple frequency of a fixed frequency used for a predetermined intellectual property (IP) block may act as a noise for peripheral components in some cases. For example, in the case of operating at a multiple frequency, the multiple frequency acts as a noise on a particular frequency band so that a signal quality may be deteriorated due to the electromagnetic interference (EMI) in the mobile electronic apparatus.

In order to avoid the above-mentioned problem, a shield tape may be used to change the operating frequency of the oscillator, or to prevent the electromagnetic interference (EMI).

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a general aspect, a display driver Integrated Circuit (IC) includes a register map configured to store a trim code, a window size, compensation information, and a compensation option, an oscillator configured to generate an oscillator clock based on the trim code, a timing controller configured to generate an internal synchronization signal based on the generated first oscillator clock, a Display Serial Interface (DSI) block configured to output a first data valid signal which is activated based on a data clock and an image data packet update; and a frequency compensating block configured to compare a periodic value of the oscillator clock with a target periodic value, and generate a compensation trim code obtained by compensating the trim code in accordance with a result of the comparing and the compensation option, in accordance with the first data valid signal, wherein the periodic value is calculated from the data clock and the internal synchronization signal, and wherein the oscillator is configured to output a compensation oscillator clock in accordance with the compensation trim code.

The frequency compensating block may include a clock counter configured to receive the window size and count the data clock and the number of oscillator clocks based on the first data valid signal, a Finite State Machine (FSM) configured to be synchronized with the internal synchronization signal to output a first control signal and a second control signal based on a predetermined state, and perform the frequency compensating operation, a first calculator configured to calculate a periodic value of the oscillator clock based on the window size, the periodic value of the data clock, and the number of oscillator clocks when the first control signal is received; and a compensation processor configured to generate the compensation trim code based on a compensating direction and a compensation option determined by comparing the periodic value of the oscillator clock with the target periodic value, and configured to apply the compensation trim code to the oscillator when the second control signal is received.

The compensation information may include the periodic value of the data clock, the target periodic value, and a changed periodic value, and the compensation option comprises a step adjusting option, a threshold value setting option, an internal synchronization selecting option, and a current code selecting option.

The clock counter may include a clock domain crossing (CDC) synchronizer configured to generate a second data valid signal obtained by synchronizing the first data valid signal with the oscillator clock, an oscillator clock counter configured to count the number of oscillator clocks based on the second data valid signal, a reference data clock counter configured to count a number of data clocks for the first data valid signal to calculate a number of input pixels, a window update size confirmer configured to compare the number of input pixels with the window size to output the number of data clocks and a result of the comparing; and a count output performer configured to output a first update completion signal in accordance with the result of the comparing and output the number of data clocks and the number of oscillator clocks.

States of the FSM may include an idle state in which the frequency compensating operation is disabled, a wait state that waits for the image data packet update to be completed, a ready state in which when the image data packet update is completed, the FSM is synchronized with the internal synchronization signal, a calculating state in which the FSM is synchronized with the internal synchronization signal to perform the frequency compensating operation; and an apply state which applies the compensation trim code to be synchronized with the internal synchronization signal to the oscillator, and stabilizes the compensation trim code, and wherein the FSM is configured to output the first and second control signals based on the states of the FSM.

The FSM may be synchronized with a vertical synchronization signal to apply the compensation trim code to the oscillator when the state changes from the calculating state to the apply state; and the FSM may be synchronized with a next vertical synchronization signal to enter the wait state for a next frequency compensating operation when the state changes from the apply state to the wait state.

The FSM may be synchronized with a horizontal synchronization signal to apply the compensation trim code to the oscillator when the state changes from the calculating state to the apply state; and the FSM may be configured to be synchronized with a next vertical synchronization signal to enter the wait state for a next frequency compensating operation when the state changes from the apply state to the wait state.

The FSM may be configured to be synchronized with a vertical synchronization signal to apply the compensation trim code to the oscillator when the state changes from the calculating state to the apply state; and the FSM may be configured to be synchronized with a next horizontal synchronization signal to enter the wait state for a next frequency compensating operation when the state changes from the apply state to the wait state.

The FSM may be configured to be synchronized with a horizontal synchronization signal to apply the compensation trim code to the oscillator when the state changes from the calculating state to the apply state, and the FSM is configured to be synchronized with a next horizontal synchronization signal to enter the wait state for a next frequency compensating operation when the state changes from the apply state to the wait state. configured to be synchronized with a next horizontal synchronization signal to enter the wait state for a next frequency compensating operation when the state changes from the apply state to the wait state.

The compensation processor may include a step distance calculator configured to output a difference, a result sign value, and a zero-result value by comparing the periodic value of the oscillator clock and the target periodic value, and calculate a number of steps in accordance with the difference, based on a changed periodic value, a code step adjuster configured to determine an adjusted step based on the number of steps and the compensation option, a reference code selector configured to select one of the trim code and the compensation trim code as a reference code based on the compensation option; and a compensation code calculator configured to apply the adjusted step to the reference code to generate a result code. The compensation processor may further include a forbidden code checker configured to output the result code based on the result sign value and the zero-result value when the second control signal is received, and output an available adjacent result code when the result code is a forbidden code.

If a step adjusting option is zero, the code step adjuster may determine a unit step as an adjusted step and if a step adjusting step is not zero, the number of steps may be determined as the adjusted step based on a predetermined table, and when the number of steps is smaller than a threshold value, the unit step may be determined as the adjusted step.

The forbidden code checker may be configured to transmit a feedback to the oscillator to maintain a current trim code if the difference is the zero result value, and output the result code selected in accordance with the result sign value if the difference is not the zero result value.

The step adjusting option may not be zero, the step adjusting option may determine a value obtained by dividing the number of steps into N (N is a natural number) as the adjusted step.

In a general aspect, method of adjusting an operating frequency of a display driver integrated circuit (IC) generating, by an oscillator, an oscillator clock based on a trim code, receiving a first data valid signal which is activated based on a data clock and an image data packet update, confirming a result sign value by comparing a periodic value of the oscillator clock that is calculated based on a window size and an internal synchronization signal with a target periodic value that is based on the first data valid signal and calculating a difference between the periodic value of the oscillator clock and the target periodic value, determining an adjusted step based on a step adjusting option and a threshold value setting; and updating a result code obtained by applying the determined adjusted step to a reference code, and outputting the result code to the oscillator as a compensation trim code.

The confirming may include generating a second data valid signal obtained by synchronizing the first data valid signal with the oscillator clock, counting a number of oscillator clocks for the second data valid signal and a number of data clocks for the first data valid signal; and confirming that the image data packet update is completed when the number of data clocks is equal to the window size.

The calculating may include outputting a first control signal and a second control signal by changing to any one of an idle state, a wait state, a ready state, a calculating state, and an apply state by synchronizing a Finite State Machine (FSM) with the internal synchronization signal, calculating a periodic value of the oscillator clock based on a periodic value of the data clock, the window size, and the number of oscillator clocks based on the first control signal, calculating the result sign value and the difference by comparing the calculated periodic value of the oscillator clock and the target periodic value, generating the compensation trim code based on the result sign value and a compensation option; and outputting the compensation trim code to be reflected to the oscillator when the second control signal is received.

In the outputting of the second control signal, when the state changes from the calculating state to the apply state, the compensation trim code may be applied to the oscillator by being synchronized with a vertical synchronization signal, and when the state changes from the apply state to the wait state, the wait state is for a next frequency compensating operation to be synchronized with a next vertical synchronization signal.

In the outputting of the second control signal, when the state changes from the calculating state to the apply state, the compensation trim code may be applied to the oscillator by being synchronized with a horizontal synchronization signal and when the state changes from the apply state to the wait state, the wait state is for a next frequency compensating operation to be synchronized with a next vertical synchronization signal.

In the outputting of the second control signal, when the state changes from the calculating state to the apply state, the compensation trim code may be applied to the oscillator by being synchronized with the vertical synchronization signal and when the state changes from the apply state to the wait state, the wait state is for a next frequency compensating operation to be synchronized with a next horizontal synchronization signal.

In the outputting of the second control signal, when the state changes from the calculating state to the apply state, the compensation trim code may be applied to the oscillator by being synchronized with a horizontal synchronization signal and when the state changes from the apply state to the wait state, the wait state is for a next frequency compensating operation to be synchronized with a next horizontal synchronization signal.

In the determining of an adjusted step, when a step adjusting option is zero, a unit step may be determined as the adjusted step, when the step adjusting option is not zero, the number of steps is determined as the adjusted step based on a predetermined table and when the number of steps is smaller than a threshold value, the unit step is determined as the adjusted step.

As the reference code, one of the trim code and the compensation trim code may be selected in accordance with a reference code selecting option.

In the outputting of the compensation trim code to the oscillator, when the result code is not a forbidden code, the result code may be output as the compensation trim code, when the difference is a zero result value, the reference code is output as the compensation trim code, and when the result code is the forbidden code, an available adjacent result code is output as the compensation trim code.

The method may include calculating an offset based on the internal synchronization signal, a scatter option, and the oscillator clock; and generating a modified trim code obtained by applying the offset to the compensation trim code to output the modified trim code to the oscillator.

The calculating the offset may include selecting a calculating method based on the scatter option and setting a magnitude of the offset and interval information; and adjusting the internal synchronization signal to a calculated synchronization signal based on the interval information and the oscillator clock.

Other features and aspects will be apparent from the following detailed description, the drawings, and the claims.

BRIEF DESCRIPTION OF THE DRAWINGS

FIGS. 4A and 4B illustrate examples of conceptual views of a Finite State Machine (FSM) illustrated in FIG. 2;

Figure 1:
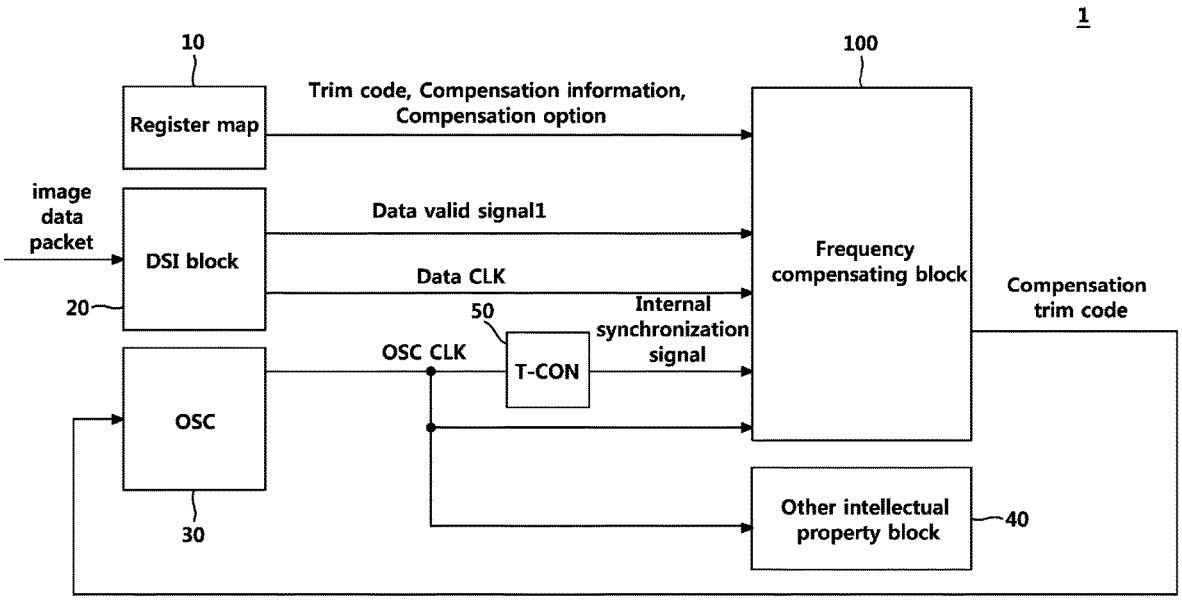
FIG. 1 is a block diagram illustrating an example of a display driver IC including an oscillator frequency compensating block in accordance with one or more embodiments.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Unless otherwise defined, all terms, including technical and scientific terms, used herein have the same meaning as commonly understood by one of ordinary skill in the art to which this disclosure pertains after an understanding of the present disclosure. Terms, such as those defined in commonly used dictionaries, are to be interpreted as having a meaning that is consistent with their meaning in the context of the relevant art and the present disclosure, and are not to be interpreted in an idealized or overly formal sense unless expressly so defined herein.

In this specification, a singular expression is used to be interchangeable with "at least one" to denote one or more of described elements.

A technical object to be achieved by the examples provides a display driving IC and an operating frequency control method which are compensated to operate at a target frequency to be insensitive to the temperature change, the voltage change, or the process change in accordance with the operation.

Further, another technical object to be achieved by the examples provides a display driving IC and an operating frequency control method which reduce a peak value of an EMI noise due to the fixed frequency in the oscillator.

Furthermore, another technical object to be achieved by the examples provides a display driving IC and an operating frequency control method which maintain a target frequency while scattering a noise spectrum of the fixed frequency.

FIG. 1 is a block diagram illustrating a display driver IC including an oscillator frequency compensating block according to an example.

Referring to FIG. 1, the display driver IC 1 may include a register map 10, a Display Serial Interface (DSI) block 20, an oscillator 30, other intellectual property (IP) block 40, a timing controller 50, and a frequency compensating block 100.

The display driver IC 1 of the example may be connected to a display panel. The display panel may be a thin film transistor liquid crystal display (TFT-LCD), a light emitting diode (LED) display, an organic LED (OLED) display, an active matrix OLED (AMOLED) display, a flexible display, or the like, but is not limited thereto.

The register map 10 is a programmable memory and stores information required for compensation of an operating frequency of the display driver IC and a value for an option. The register map may be programmed by an application processor or programmed to be different from each other for every display driver IC. The register map 10 stores a trim code which becomes a foundation for generating an operating frequency, information pertaining to a display panel (for example, a resolution or a window size), and function option information (for example, and a compensation option and compensation information).

The timing controller 50 may generate an internal synchronization signal for driving a display panel (not illustrated) connected to the display driver IC 1. The internal synchronization signal may be generated based on an oscillator clock and includes a horizontal synchronization (Hsync) signal and a vertical synchronization (Vsync) signal.

The oscillator 30 may generate an oscillator clock OSC CLK in accordance with a trim code. The trim code is information pertaining to an operating frequency for driving the display panel. For example, the trim code is expressed by a complementary number of 2 and the trim code starts with a value read from the register map 10 at the time of initial driving and then a compensation trim code is generated by a compensation operation by the frequency compensating block 100.

The other intellectual property (IP) block 40 performs a predetermined function based on the oscillator clock of the operating frequency received from the oscillator.

The DSI block 20 receives image data packet from a host to output a first data valid signal and a data clock.

When the operating frequency in accordance with the trim code received from the register map 10 is deviated from the target frequency due to the temperature change, the voltage change, or the process change in accordance with the display driving, the frequency compensating block 100 performs a frequency compensation operation to compensate the operating frequency to be the target frequency.

To be more specific, when the first data valid signal is activated in accordance with the received image data packet, the frequency compensating block 100 compares the current operating frequency, that is, a periodic value of the oscillator clock with a target periodic value and generates a compensation trim code obtained by adjusting the trim code in accordance with the comparison result and the compensation option. In this example, the compensation information and compensation option are read from the register map 10 and the compensation information includes a data CLK periodic value, a target periodic value, and a changed periodic value. Further, the compensation option includes a step adjusting option, a threshold setting option, an internal synchronization selecting option, and a current code selecting option.

Even though not illustrated in the drawing, an oscillator frequency controller includes the frequency compensating block 100. When the operating frequency in accordance with the trim code received from the register map 10 is deviated from the target frequency due to the temperature change, the voltage change, or the process change in accordance with the driving of the display, the oscillator frequency controller performs a frequency compensation operation to be operated at the target frequency again.

Figure 2:
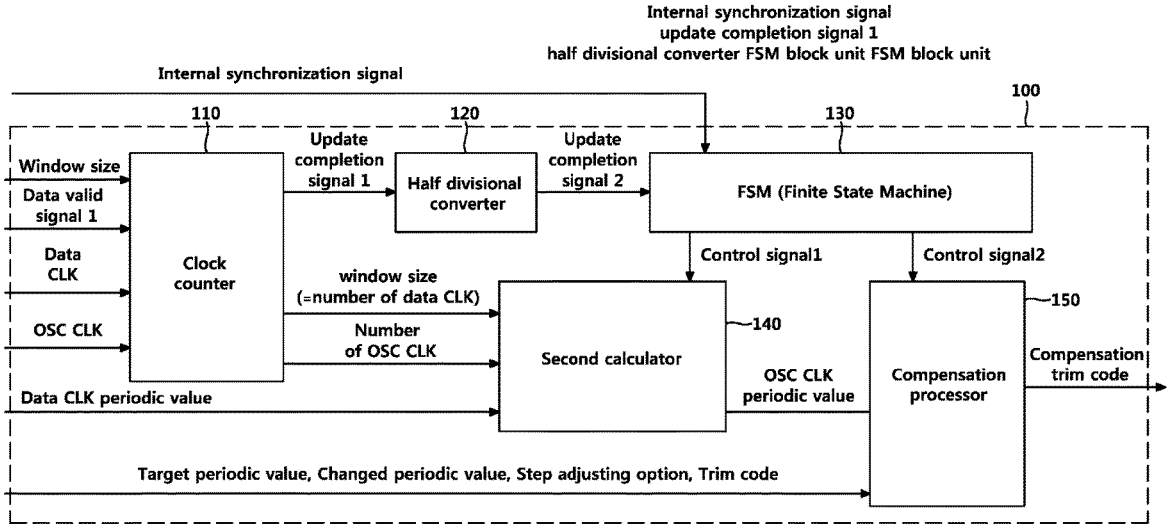
FIG. 2 is a block diagram illustrating an example of a frequency compensating block illustrated in FIG. 1.

FIG. 2 is a block diagram illustrating an example of a frequency compensating block illustrated in FIG. 1.

Referring to FIG. 2, the frequency compensating block 100 includes a clock counter 110, a Finite State Machine (FSM) 130, a second calculator 140, and a compensation processor 150.

When a first data valid signal is activated by updating an image data packet from the DSI block 20 (for example, when an image data packet corresponding to a set window size is completely updated, the first data valid signal is activated), the clock counter 110 receives window size information from the register map 10, generates a second data valid signal obtained by synchronizing the first data valid signal with the oscillator clock domain (clock domain crossing: hereinafter, abbreviated as CDC), and counts oscillator clocks for the second data valid signal to sample the number of oscillator clocks. The clock counter 110 will be described in detail with reference to FIG. 3.

A half-divisional converter 120 divides an oscillator clock at the time of performing an operation to generate a compensation trim code, and in the illustrated example, the oscillator clock is divided into two, but according to various examples, the oscillator clock may be divided into N. In this example, N is a natural number. The half-divisional converter 120 outputs a second update completion signal obtained by dividing the first update completion signal into two. The first update completion signal is a signal generated from the clock counter 110 when an image data packet corresponding to the window size from the host is completely updated.

The FSM 130 is synchronized with the internal synchronization signal to determine whether to compensate the frequency while changing the state. The FSM 130 outputs a first control signal and a second control signal depending on a determined state to control the second calculator 140 and the compensation processor 150. The FSM 130 will be described in detail with reference to FIG. 4.

The second calculator 140 may calculate a periodic value of the oscillator clock which is supplying at the current operating frequency, based on the first control signal (control signal 1) received from the FSM 130, the periodic value of the data CLK, the window size (=number of data clocks), and the number of oscillator CLK.

The compensation processor 150 compares the periodic value of the oscillator clock calculated in the second calculator 140 with a target periodic value read from the register map 10. The compensation processor 150 determines a compensating direction based on a result sign value of a difference between the periodic value of the oscillator clock and the target periodic value as a comparison result and generates a compensation trim code in accordance with the compensation option. Further, when a second control signal (control signal 2) is received, the compensation processor 150 outputs the compensation trim code to apply the compensation trim code to the oscillator 30 (FIG. 1).

The difference between the periodic value of the oscillator clock and the target periodic value is obtained by subtracting the target periodic value from the periodic value of the oscillator clock and is a value for a time. The compensating direction refers to a direction in which the target periodic value is increased or decreased with respect to the calculated periodic value of the oscillator clock. That is, the compensating direction may refer to a direction indicating whether the currently calculated oscillator clock periodic value should be increased or decreased based on the target periodic value. The compensation option determines a size of the adjusting step in accordance with the magnitude of the difference between the periodic value of the oscillator clock and the target periodic value.

Figure 3:
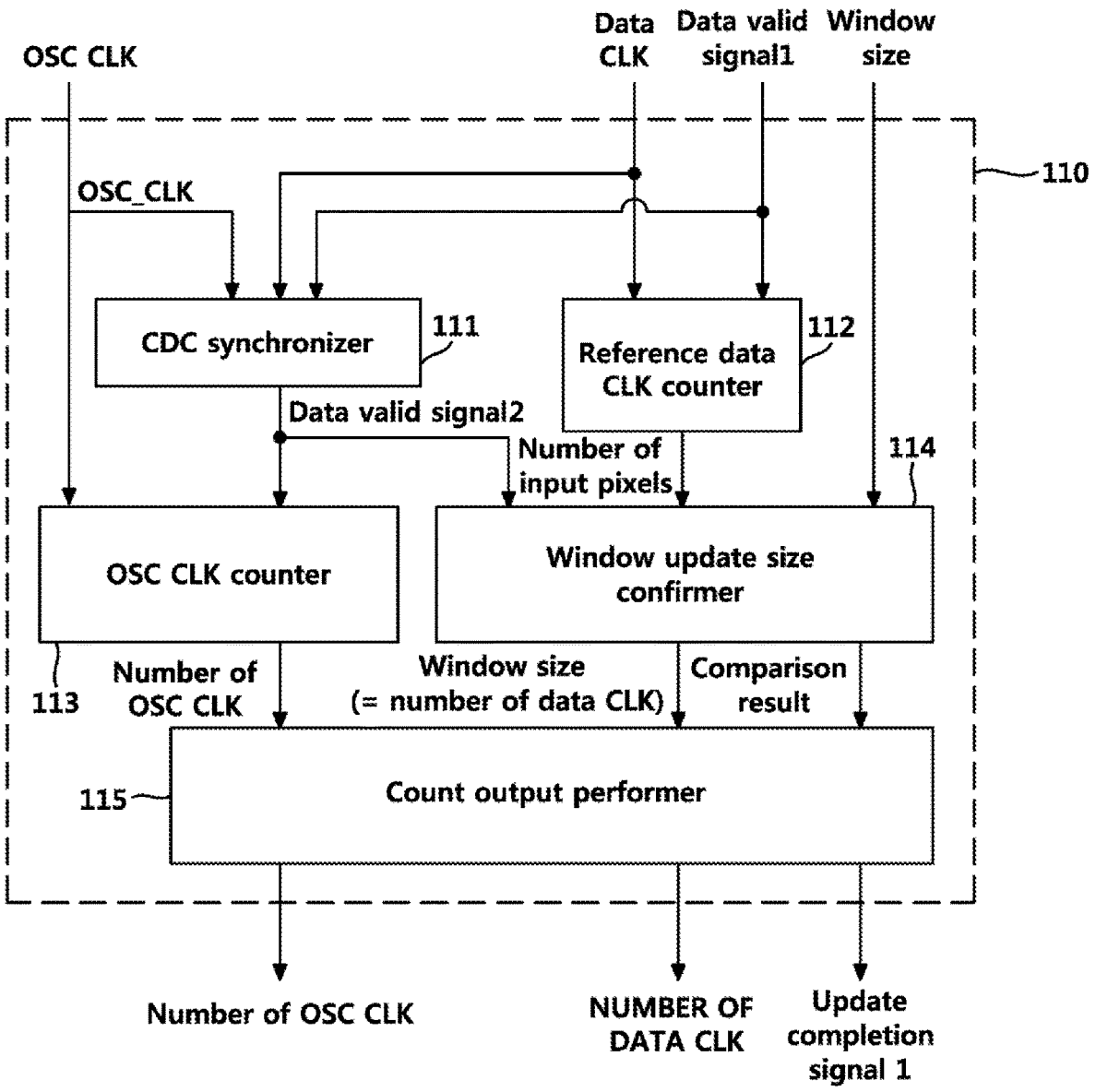
FIG. 3 is a block diagram illustrating an example of a clock counter illustrated in FIG. 2.

FIG. 3 is a block diagram illustrating an example of a clock counter illustrated in FIG. 2.

Referring to FIG. 3, the clock counter 110 may include a CDC synchronizer 111, a reference data clock counter 112, an oscillator clock counter 113, a window update size confirmer 114, and a count output performer 115.

The CDC synchronizer 111 synchronizes (CDC processes) the data valid signal from the data clock domain to an oscillator clock domain. For the convenience of description, it is assumed that a data valid signal of the data clock domain is a first data valid signal (data valid signal 1) and a data valid signal of the oscillator clock domain is a second data valid signal (data valid signal 2).

The oscillator clock counter 113 counts a number of oscillator clocks for the second data valid signal to output the number of oscillator clocks to the count output performer 115.

When image data packet is input to activate the data valid signal, the reference data clock counter 112 calculates the number of input pixels of an input image data packet by counting the number of data clocks for the first data valid signal. The reference data clock counter 112 calculates the number of input pixels of a partial image data packet which is changed, in the entire image data packet, that is, a window size which is actually being updated.

The window update size confirmer 114 confirms whether the pixel data is input in a number that is equal to the window size, by comparing the calculated number of input pixels with the window size. In this example, the information on the window size may be received from the register map 10. The window update size confirmer 114 outputs a comparison result of the input pixel number and the window size and the number of data clocks (that is, the window size information) to the count output performer 115.

Therefore, the clock counter 110 uses the window size information so that the compensation operation may be performed not only when the entire area for a panel resolution is updated, but also when a partial area of the panel is updated. When a specific reference value such as the absolute time is set, if a larger reference value than the image data packet update time is set, there may be a restriction in which the compensation operation is not satisfactorily performed. Therefore, like the absolute time, the specific reference value may not be set, but it may be confirmed by comparing the number of input pixels and a window size specified by the user to confirm whether the update is completed. Therefore, whenever the user updates the window as desired, the compensation operation may be performed. When it is determined that the update is completed, the first update completion signal is generated.

When pixel data for the specified window size is input, the window size may be equal to the number of data clocks. Further, when the synchronized data valid signal is inactivated due to the image data packet update completion, the comparison result is flagged with the first update completion signal to be used as a trigger to perform the frequency compensation operation.

The window size (the number of data CLK) refers to a size of an image data packet transmitted from the host and may be an entire image data packet size which is a panel resolution criterion or a partial image data packet size depending on the setting. Therefore, the frequency may be compensated by updating not only the entire image data packet, but also the partial image data packet.

When the number of input pixels is equal to the window size based on the comparison result signal, the count output performer 115 outputs a pulse type first update completion signal notifying that the image data packet from the DSI block 20 is completely updated. Further, the count output performer 115 outputs a number of oscillator clocks counted for the second data valid signal in the oscillator clock counter 113 and the window size (=the number of data clocks) received from the window update size confirmer 114.

FIGS. 4A and 4B are conceptual views illustrating a finite state machine (FSM) illustrated in FIG. 2.

Referring to FIG. 4A, according to an example, the FSM 130 may include an idle state, a wait state, a ready state, a calculating state (CALCU), and an apply state.

In the idle state, the frequency compensating operation may be disabled. That is, when the FSM enters an undefined state during a finite state machine operation, a next state becomes an idle state. When the Oscillator Frequency Controller (OFC) is enabled, the FSM enters from the idle state to the wait state.

The wait state is a state waiting for update completion from the clock counter 110 and waits until first and second update completion signals are generated in accordance with the update completion after starting the update of the image data packet. That is, when the update completion signal is generated, it enters from the wait state to the ready state.

The ready state is a state to which the FSM 130 enters immediately after generating the update completion signal in accordance with the image data packet update completion from the clock counter 110 in the wait state. The ready state is a state for synchronizing with the internal synchronization signal. That is, in the ready state, the FSM is synchronized with the internal synchronization signal to enter the next state.

The calculating state (CALCU) is a state in which the periodic value of the current oscillator clock is generated and the frequency compensating operation is performed depending on the compensation option to generate a compensation result code and the FSM is synchronized with the internal synchronization signal to calculate the compensation trim code. However, in this state, the result code generated through the compensating operation is not directly reflected to the oscillator (OSC) 30 (FIG. 1). The FSM enters the apply state by the internal synchronization signal selected by the option.

In the apply state, the compensation trim code which is synchronized with the internal synchronization signal selected by the compensation option to be calculated in the previous state is applied. The FSM block is synchronized with the internal synchronization signal selected in accordance with the compensation option to enter the wait state. In this example, the internal synchronization signal which enters the wait state may be selected so that a stabilization time may be applied after applying the compensation trim code. That is, in the apply state, even though the update completion signal is generated, the update completion signal may be ignored so that the stabilization time may be ensured.

The FSM 130 is synchronized with the internal synchronization signal to enter from the ready state, the calculating state (CALCU), and the apply state to the next state. Specifically, in order to enter from the calculating state (CALCU) and the apply state to the next state, the FSM is synchronized with the selected internal synchronization signal to enter the next state. That is, a timing to apply the compensation trim code and the stabilization time may be adjusted by the selected internal synchronization signal.

FIG. 4B is a table representing an application effect in accordance with an entering option of the wait state and the apply state.

In a first row of the table, the FSM is synchronized with a vertical synchronization signal (vsync) by options 1 and 2 to enter the apply state and apply the compensation trim code, and maintains the apply state until a next vertical synchronization signal (vsync) is generated to stabilize the compensation trim code. As a result, the compensation trim code is stabilized for one frame and the compensation trim codes are not mixed for one frame. To be more specific, in order to enter from the apply state to the wait state in the option 1 of the first row, the FSM is synchronized with the vertical synchronization signal (vsync) to enter the wait state for a next frequency compensating operation to wait for the update completion signal to be generated. In the option 2 of the first row of the table, in order to enter from the calculating state to the apply state, the FSM is synchronized with the vertical synchronization signal (vsync) to enter the apply state and apply the compensation trim code to the oscillator 30. The applied compensation trim code is generated in the calculating state.

In a second row of the table, the FSM is synchronized with a horizontal synchronization signal (hsync) by options 1 and 2 to enter the apply state and apply the compensation trim code, and the stabilization is applied until a next vertical synchronization signal (vsync) is generated. As a result, the compensation trim code stabilization is applied for 1 H or more and the compensation trim codes may be mixed for one frame. To be more specific, in order to enter from the apply state to the wait state in the option 1, the FSM is synchronized with the vertical synchronization signal (vsync) to enter from the apply state to the wait state to wait for the update completion signal for starting a next frequency compensation operation to be generated. Further, in the option 2, the FSM is synchronized with the horizontal synchronization signal (hsync) to enter from the calculating state to the apply state to apply the compensation trim code to the oscillator.

In a third row of the table, the FSM is synchronized with a vertical synchronization signal (vsync) by options 1 and 2 to enter the apply state and apply the compensation trim code and maintains the apply state until a next horizontal synchronization signal (hsync) is generated to be stabilized. As a result, the stabilization is applied for 1 H or more and the compensation trim codes are not mixed for one frame. To be more specific, in the option 1, the FSM block code is synchronized with the horizontal synchronization signal (hsync) to enter from the apply state to the wait state for a next frequency compensating operation and wait for the update completion signal to be generated. Further, in the option 2, the FSM is synchronized with the vertical synchronization signal (vsync) to enter from the calculating state to the apply state to apply the compensation trim code generated in the calculating state to the oscillator.

In a fourth row of the table, the FSM is synchronized with the horizontal synchronization signal (hsync) by the options 1 and 2 to enter the apply state and apply the compensation trim code generated in the calculating state and stabilize the compensation trim code until a next horizontal synchronization signal (hsync) is generated. As a result, the stabilization is applied for 1 H and the compensation trim codes may be mixed for one frame. In the option 1, the FSM is synchronized with the horizontal synchronization signal (hsync) to enter from the apply state to the wait state and wait for the update completion signal for starting a next frequency compensating operation to be generated. Further, in the option 2, the FSM is synchronized with the horizontal synchronization signal (hsync) to enter from the calculating state to the apply state to apply the compensation trim code to the oscillator.

In summary, the FSM 130 may enter from the calculating or apply state to a next state by being synchronized with the selected internal synchronization signal. That is, when the FSM enters from the calculating state to the apply state or from the apply state to the wait state, according to an example, the frequency compensating block may prevent a mixing of the compensation trim code for one frame, by the internal synchronization signal selected by the options 1 and 2 and the apply state may be maintained longer to apply a stabilization time. Further, according to another example, the frequency compensating block maintains the apply state for a short time period so that it immediately enters the wait state to start the compensating operation as soon as the update completion signal is generated. That is, a timing to apply the compensation trim code and the stabilization time may be adjusted by the selected internal synchronization signal.

The FSM 130 outputs the internal synchronization signal selected by the option 2 (enters the apply state) illustrated in the table of FIG. 4B as a second control signal (control signal 2) to transmit the internal synchronization signal to the compensation processor 150. That is, the FSM 130 enters the apply state and the compensation processor 150 applies the compensation trim code to the oscillator 30 in accordance with the second control signal (control signal 2).

The second calculator 140 determines whether to perform the arithmetic operation for frequency compensation in accordance with the first control signal (control signal 1). That is, the FSM enters the calculating state (CALCU) and the second calculator 140 calculates the oscillator clock periodic value and generates the compensation trim code by the first control signal.

The second calculator 140 calculates a periodic value of the oscillator clock which is supplied at a current operating frequency based on the periodic value of the data clock, the window size (=the number of data clocks), and the number of oscillator clocks. In order to calculate a precise periodic value of the oscillator clock, a periodic value of a data clock precisely corresponding to an image data packet transmission speed setting used for a set needs to be provided from the register map 10.

Even though not illustrated in the drawing, the second calculator 140 may be implemented by a serial calculator, that is, a serial multiplication and division calculator. In this example, since the calculation is repeatedly and accumulatively performed by an adder so that the number of gates required to implement the calculator may be reduced and an operating timing of the calculator may be relieved. However, in order to increase precision for the result value, it is required to increase the number of operand bits. In this case, the serial calculator generates a result after clock cycles as many as the number of operand bits.

Therefore, the second calculator 140 requires a plurality of clock cycles to obtain a result value using the serial calculator but may calculate the periodic value of the oscillator clock having a high precision with a small hardware size.

The compensation processor 150 compares the periodic value of the oscillator clock calculated in the second calculator 140 with a target periodic value read from the register map 10. A compensating direction is determined based on a difference between the periodic value of the oscillator clock and the target periodic value as a comparison result and a compensation trim code is generated in accordance with the compensation option. Further, when the second control signal (control signal 2) is received, the compensation processor 150 outputs the compensation trim code to reflect the compensation trim code to the oscillator 30.

The compensation processor 150 will be described in more detail with reference to FIGS. 5 and 6.

Figure 5:
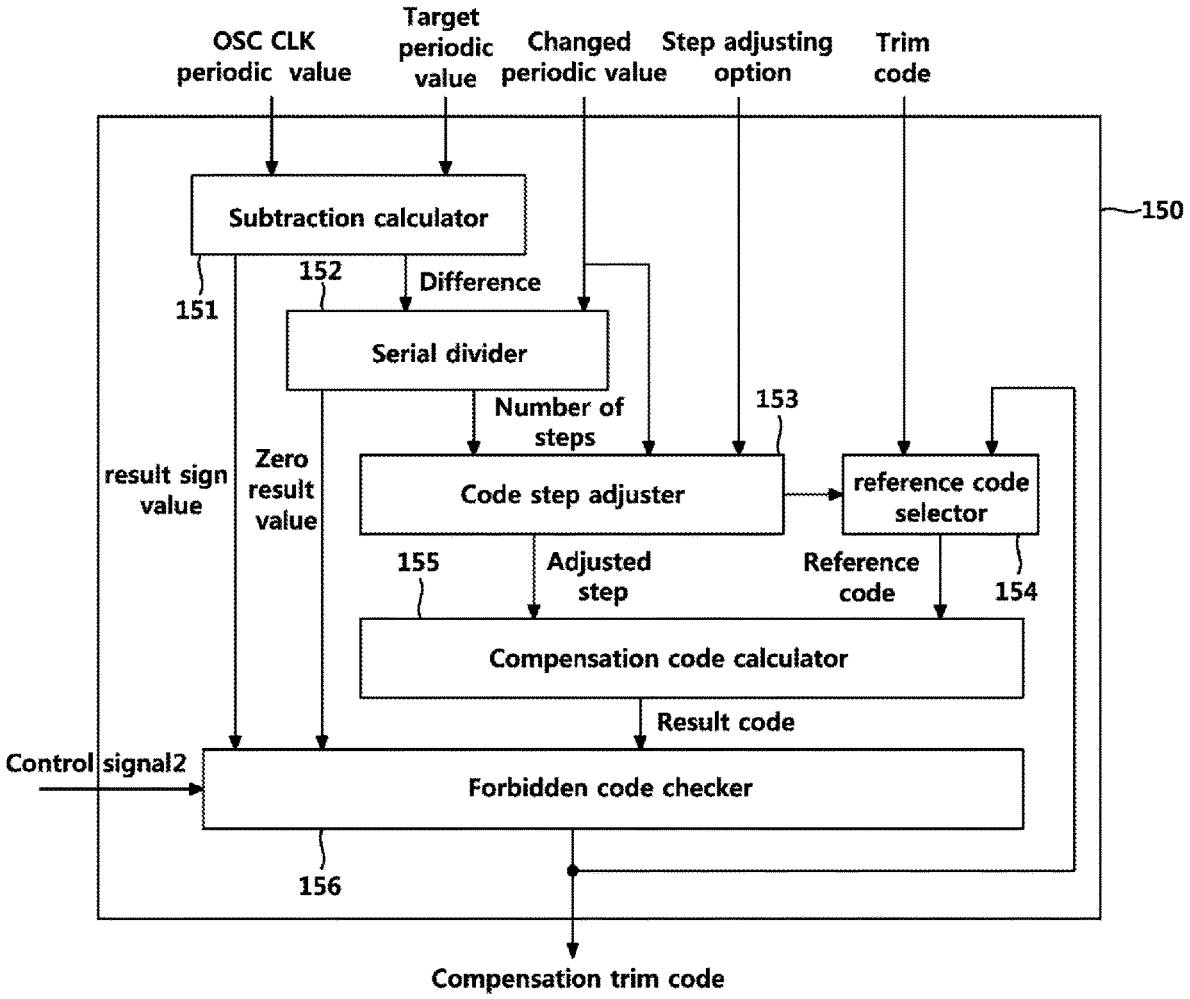
FIG. 5 is a block diagram illustrating an example of a compensation processor illustrated in FIG. 2.

FIG. 5 is a block diagram illustrating an example of a compensation processor illustrated in FIG. 2.

Referring to FIG. 5, the compensation processor 150 may include a step distance calculator (including a subtraction calculator 151 and a serial divider 152), a code step adjuster 153, a reference code selector 154, a compensation code calculator 155, and a forbidden code checker 156.

The step distance calculators 151 and 152 compare the periodic value of the oscillator clock with the target periodic value received from the register map 10 to output a difference, a result sign value, and a zero-result value. For example, the step distance calculator includes the subtraction calculator 151 and the serial divider 152.

The subtraction calculator 151 outputs a difference between the periodic value of the oscillator clock received from the second calculator 140 and the target periodic value received from the register map 10 and generates a result sign value.

The difference is obtained by subtracting the target periodic value from the current oscillator clock periodic value and is an absolute value for a time. The generated result sign value refers to a direction indicating whether to increase or decrease the currently calculated oscillator clock periodic value, based on the target periodic value and means a compensating direction.

The serial divider 152 divides the difference output from the subtraction calculator 151 by a changed periodic value to calculate a number of steps. The changed periodic value is supplied from the register map 10 and refers to an average cycle variation for every trim code unit step.

The intellectual property (IP) blocks 40 apply the trim code to the oscillator 30 and operate at a frequency corresponding thereto. In this example, the frequency change amount or the cycle change amount between the adjacent trim codes should ideally be uniform whenever the trim code changes in one unit (hereinafter, referred to as a unit step) with respect to the trim code range of the oscillator. However, the frequency change amount or the cycle change amount may not be not uniform due to the restriction in the implementation of an actual operator. Therefore, the changed periodic value is allocated to the register map 10 to be programmable and an average cycle variation in the interested trim code range is designated by the simulation or experiment. Therefore, the difference between the oscillator clock periodic value and the target periodic value is divided by the changed periodic value to find the number of steps to reach the target frequency.

The code step adjuster 153 determines a compensation amount, that is, an adjusted step in accordance with the number of steps, the step adjusting option, and the threshold value setting.

For example, when a step adjusting option is 0 (N=0), regardless of the number of steps and the threshold value, ±1 unit step may be unconditionally used as a compensation amount. When the step adjusting option is not zero (N≠0), the compensation amount may be applied in accordance with a predetermined table indicating how many times the steps are divided depending on the N value. However, when the number of steps is equal to or larger than a predetermined threshold value, a result value obtained by dividing the number of steps by the number determined by the table is applied as the compensation amount and when the number of steps is smaller than the predetermined threshold value, ±1 unit step is used as the compensation amount. The threshold value is set so as to be stably converged and reach the target trim code by changing the compensation amount to ±1 unit step when it reaches a position close to the target trim code in the trim code range to which ±threshold value is applied, with respect to the target trim code.

For example, in the step adjusting option, with respect to the predetermined threshold value, when the calculated number of steps is equal to or larger than the threshold value, the adjusted step is determined to be a half step of the number of steps and when the number of steps is smaller than the threshold value, the adjusted step is determined to be the unit step.

For example, when the number of steps is 80 steps and the threshold value is 5, the current number of steps is larger than the threshold value so that the adjusted step is determined to be 40 steps. In the meantime, when the current number of steps is smaller than the threshold value which is 5, the adjusted step is adjusted to be a unit step.

The code step adjuster 153 transmits a signal determining which code is selected as a reference code (that is, a trim code to be compensated), to the reference code selector 154 in accordance with the reference code selecting option (=current code selecting option).

The reference code selector 154 may set a reference code to which the compensation amount is applied. That is, the code step adjuster 153 may select one of a trim code received from the register map 10 and a compensation trim code output from the frequency compensating block 100, based on the reference code selection option to output the selected code as a reference code.

The compensation code calculator 155 may apply a determined adjusted step to the reference code to generate a result code. The compensation code calculator 155 compensates for the reference code with the adjusted step, that is, adds the adjusted step or subtracts the adjusted step to generate a result code.

When the second control signal (control signal 2) is received, if the compensation trim code is a zero-result value, the forbidden code checker 156 may maintain the current compensation trim code and if the compensation trim code is not a zero result value, the forbidden code checker 156 selects and outputs a result code for addition or a result code for subtraction depending on the result sign value. Further, the result code corresponds to the forbidden code, the forbidden code checker converts the result code into an available adjacent modified trim code to output the converted code. The forbidden code is a trim code area which is not used in accordance with the implementation of the oscillator and needs to be avoided at the time of operating the oscillator.

Figure 6:
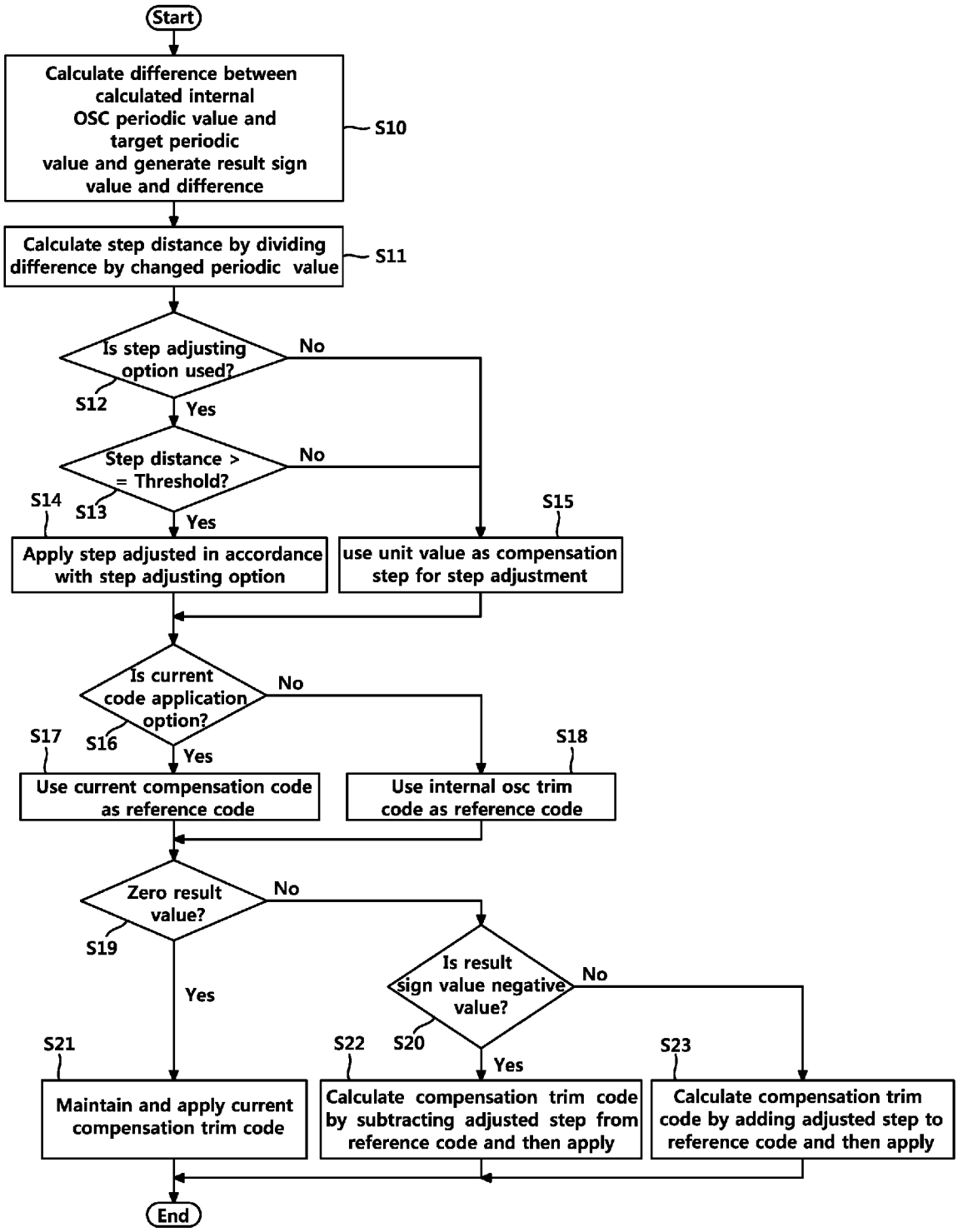
FIG. 6 is a flow chart illustrating an example of a compensation processor illustrated in FIG. 2.

FIG. 6 is a flow chart illustrating an example of a compensation processor illustrated in FIG. 2.

Referring to FIG. 6, the compensation processor 150 compares the periodic value of the oscillator clock and the target periodic value to generate a result sign value and a difference in operation S10. The difference between the periodic value of the oscillator clock and the target periodic value is divided by the changed periodic value read from the register map to calculate a step distance (the number of steps) in operation S11. The changed periodic value refers to an average cycle variation for every unit step of the trim code. The step distance (the number of steps) is an absolute value of a difference obtained by subtracting the current trim code from the target trim code and the unit is a trim code unit step.

In operation S12, a confirmation is made whether to use the step adjusting option based on the step distance, and when the step distance is equal to or larger than a predetermined threshold value in operation S13, a determination is made to use an adjusted step in accordance with the step adjusting option. When the step distance is smaller than the threshold value in operation S13, the unit step is selected in accordance with the step adjusting option.

The compensation processor 150 determines a reference code for calculating a compensation trim code in accordance with the reference code selecting option (=current code applying option). The current code applying option is selected when the target frequency is dynamically changed. In the case of the current code applying option in step S16, the current compensation trim code may be used and otherwise, a trim code provided from the register map 10 may be used as a code to be compensated in step S18.

The compensation processor 150 calculates a compensation trim code by applying a compensation amount to the reference code in operation S17 or operation S18. When the calculated compensation trim code is a zero-result value in operation S19, the compensation processor maintains the current compensation trim code as it is without applying the calculated compensation trim code in operation S21. When the calculated compensation trim code is not the zero-result value in operation S19, the compensation processor 150 confirms whether the result sign value of the calculation is a positive value or a negative value in operation S20. When the result sign value is a negative value, the compensation trim code is generated by subtracting the adjusted step from the reference code in operation S22. When the result sign value is a positive value, the compensation trim code is generated by adding the adjusted step to the reference code in operation S23.

The compensation processor 150 determines whether to output the compensation trim signal in accordance with the second control signal (control signal 2) of the FSM 130.

With reference to FIGS. 7 to 11, it is assumed that the current number of steps is 80 steps based on the difference between the periodic value of the oscillator clock and the target periodic value and the changed periodic value.

Figure 7:
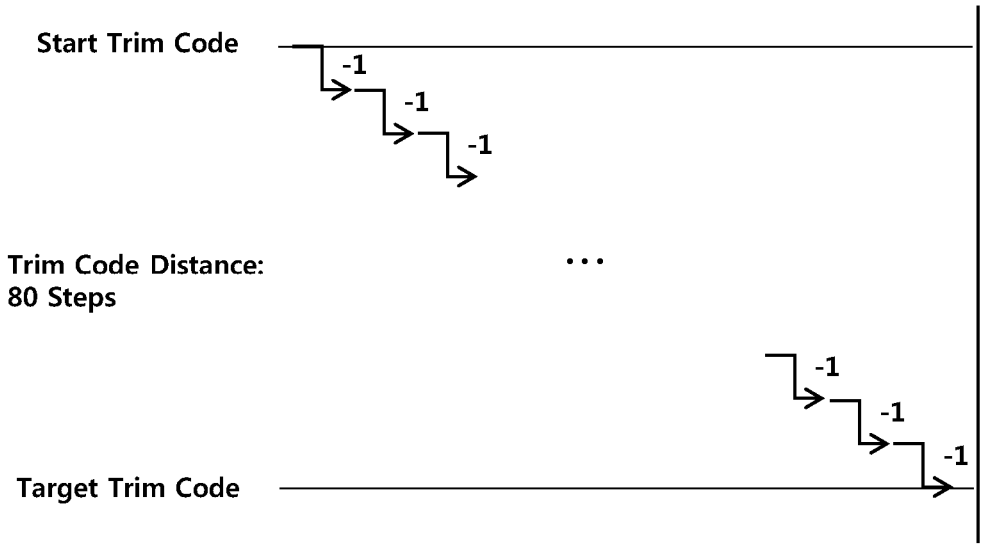
FIG. 7 is an example of a conceptual view illustrating an operation of a frequency compensating block in accordance with a step adjusting option.

FIG. 7 is a conceptual view illustrating an operation of a frequency compensating block in accordance with a step adjusting option (N=0) of an example.

Referring to FIG. 7, the frequency compensating block 100 determines the unit step as an adjusted step in accordance with the step adjusting option, regardless of the difference. That is, when a step adjusting option is 0 (N=0), regardless of the number of steps and the threshold value, ±1 unit step is unconditionally used as a compensation amount. Therefore, in the example of FIG. 7, when the image data packet update is performed 80 times, the trim code converges to the target trim code.

Figure 8:
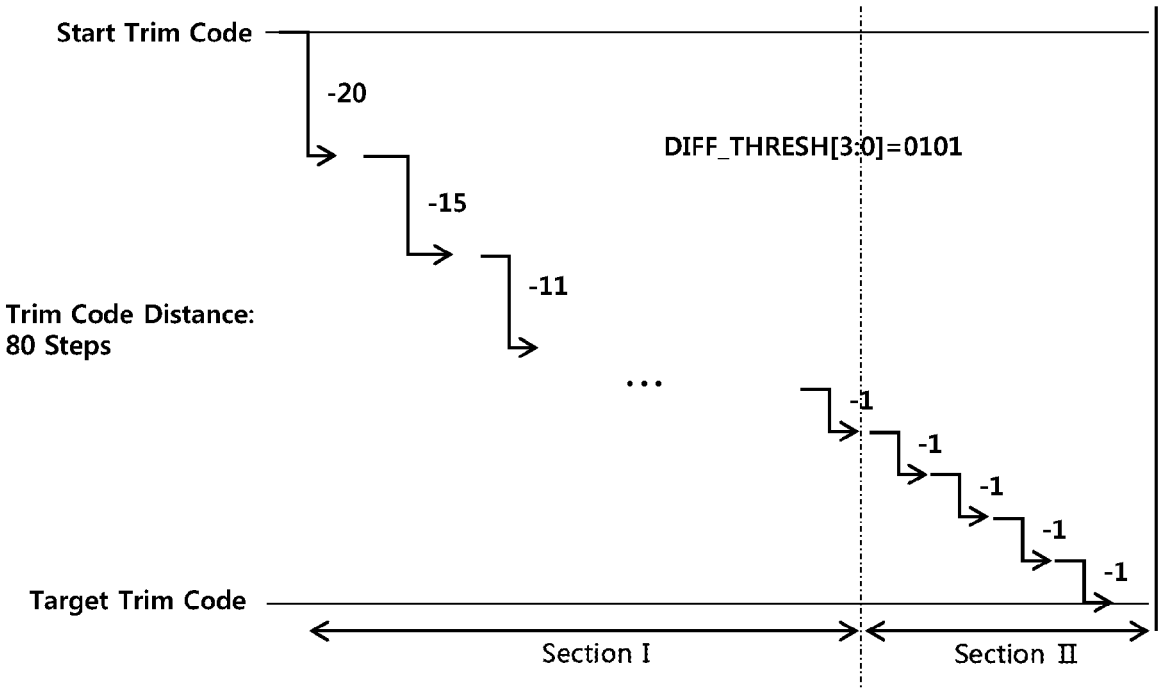
FIG. 8 is an example of a conceptual view illustrating an operation of a frequency compensating block in accordance with another step adjusting option.

FIG. 8 is a conceptual view illustrating an operation of a frequency compensating block in accordance with a step adjusting option of another example.

Referring to FIG. 8, a quarter of the step distance (the number of steps) is determined as an adjusted step in accordance with the step adjusting option (N=1). That is, when N=1, if the number of steps is equal to or greater than the set threshold value, a result value obtained by dividing the number of steps into 4 may be applied as a compensation amount, and when the number of steps is less than the set threshold value which is 5, ±1 unit step may be used as a compensation amount. Here, the threshold value is set so as to stably converge and reach the target trim code by changing the compensation amount to ±1 unit step when it reaches a position close to the target trim code in the trim code range to which ±threshold value is applied, with respect to the target trim code. Therefore, in the example of FIG. 8, when the image data packet update is performed 16 times, the compensation trim code converges to the target trim code.

Figure 9:
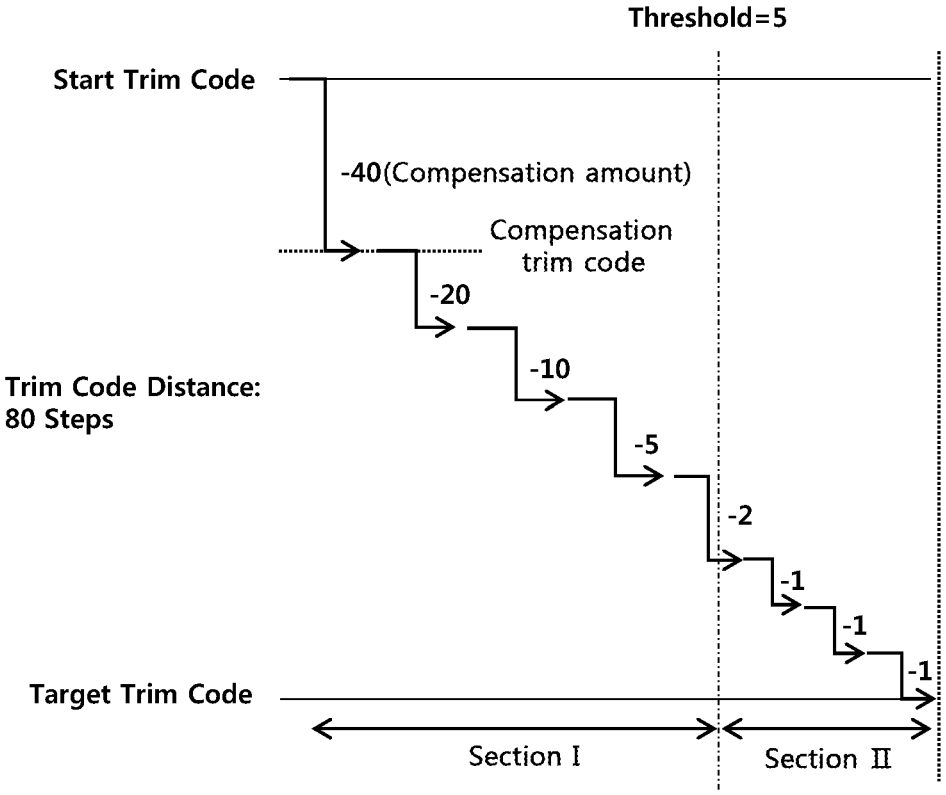
FIG. 9 is an example of a conceptual view illustrating an operation of a frequency compensating block in accordance with still another step adjusting option.

FIG. 9 is a conceptual view illustrating an operation of a frequency compensating block in accordance with a step adjusting option of another example.

Referring to FIG. 9, a half of the step distance (the number of steps) is determined as an adjusted step in accordance with the step adjusting option (N=2). That is, when N=2, if the number of steps is equal to or larger than the set threshold value, a result value obtained by dividing the number of steps by 2 is applied as a compensation amount and when the number of steps is smaller than the set threshold value which is 5, ±1 unit step is used as a compensation amount. Here, the threshold value is set so as to stably converge and reach the target trim code by changing the compensation amount to ±1 unit step when it reaches a position close to the target trim code in the trim code range to which ±threshold value is applied, with respect to the target trim code.

To be more specific, the frequency compensating block 100 (FIG. 1) may adjust a half of the step distance 80 as an adjusted step in the first compensating operation to be compensated and then the step distance is reduced to 40 steps. In the second compensating operation cycle, a half of the step distance which is 40 is adjusted as an adjusted step to be compensated and then the step distance is reduced to 20 steps. Similarly, 10 steps are applied as the adjusted step in a third compensating operation cycle, 5 steps are applied as the adjusted step in a fourth compensating operation cycle, and 2 steps are applied as the adjusted step in a fifth compensating operation cycle to compensate the frequency (Section I).

In a sixth compensating operation cycle, the step distance is 3 which is smaller than the threshold value which is 5 (Section II), so that thereafter, the step adjusting option determines unit 1 step as the adjusted step. Therefore, when a total of eight compensating operation cycles is performed, that is, image data packet updates are performed eight times, the compensation trim code converges to the target trim code.

Figure 10:
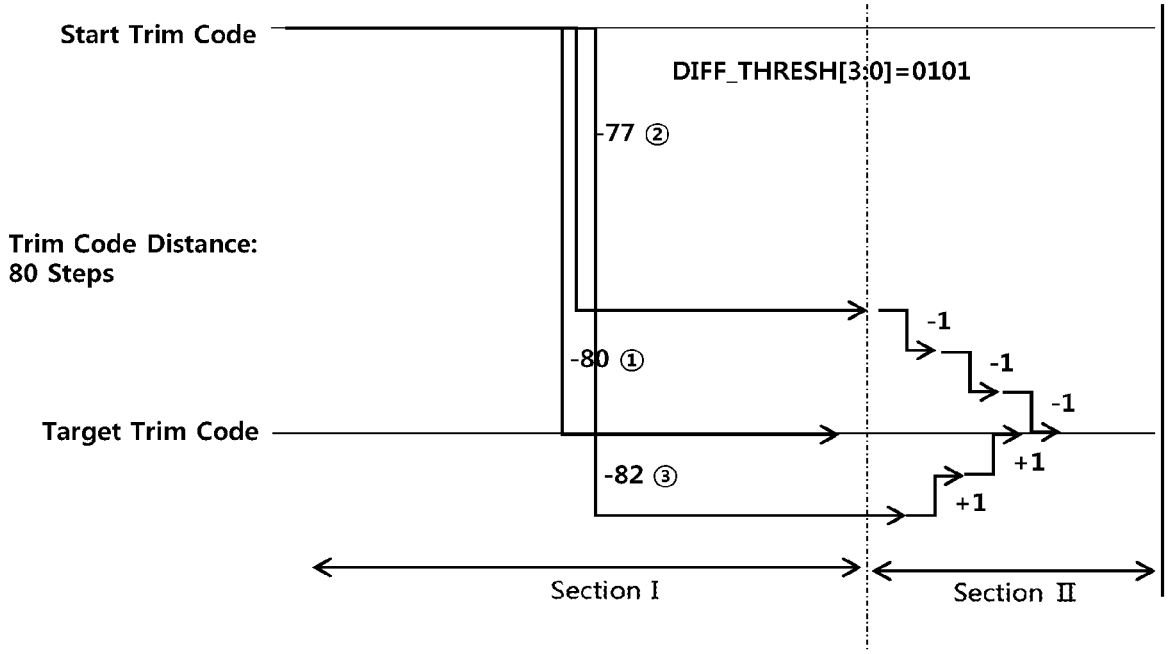
FIG. 10 is an example of a conceptual view of an operation of a frequency compensating block in accordance with still another step adjusting option.

FIG. 10 is a conceptual view illustrating an operation of a frequency compensating block in accordance with a step adjusting option (N=3) of another example.

Referring to FIG. 10, the step distance (the number of steps) may be immediately determined as an adjusted step (compensation amount) in accordance with the step adjusting option (N=3). The number of steps may be determined by dividing the difference of the oscillator periodic value and the target periodic value by a changed periodic value and in this case, the changed periodic value plays an important role. This is because it is determined whether to reach the target code at one time depending on the accuracy of the changed periodic value.

In the frequency compensating block 100 (FIG. 1), in the first compensating operation cycle, when the step distance (the number of steps) is directly determined as the adjusted step (compensation amount) in accordance with the step adjusting option (N=3) and an appropriate changed periodic value is set, the compensation trim code may converge to the target trim code at one time (①).

However, when the changed periodic value is not precisely input, the number of steps may also be inaccurate, and the compensation trim code may not immediately converge to the target trim code in the first compensating operation cycle.

For example, when the changed periodic value is not appropriately set so that the changed periodic value is set to be slightly larger, a slightly small adjusted step (compensation amount) is determined so that the compensation trim code does not reach the target trim code at one time (②). In the meantime, when the changed periodic value is not appropriately set so that the changed periodic value is set to be slightly small, a slightly large adjusted step (compensation amount) is determined so that the compensation trim code may pass by the target trim code at one time (③).

Therefore, when the changed periodic value is not appropriately set, the compensation trim code may not converge to the target trim code at one time, but may eventually converge to the target trim code by several times of compensating operations.

Although in FIGS. 7 to 10, the compensation amount is specified as a specific division value of the step distance to illustrate that the step adjustment (compensation amount) varies in accordance with the step adjusting option, the examples are not limited to a specific division value.

Figure 11:
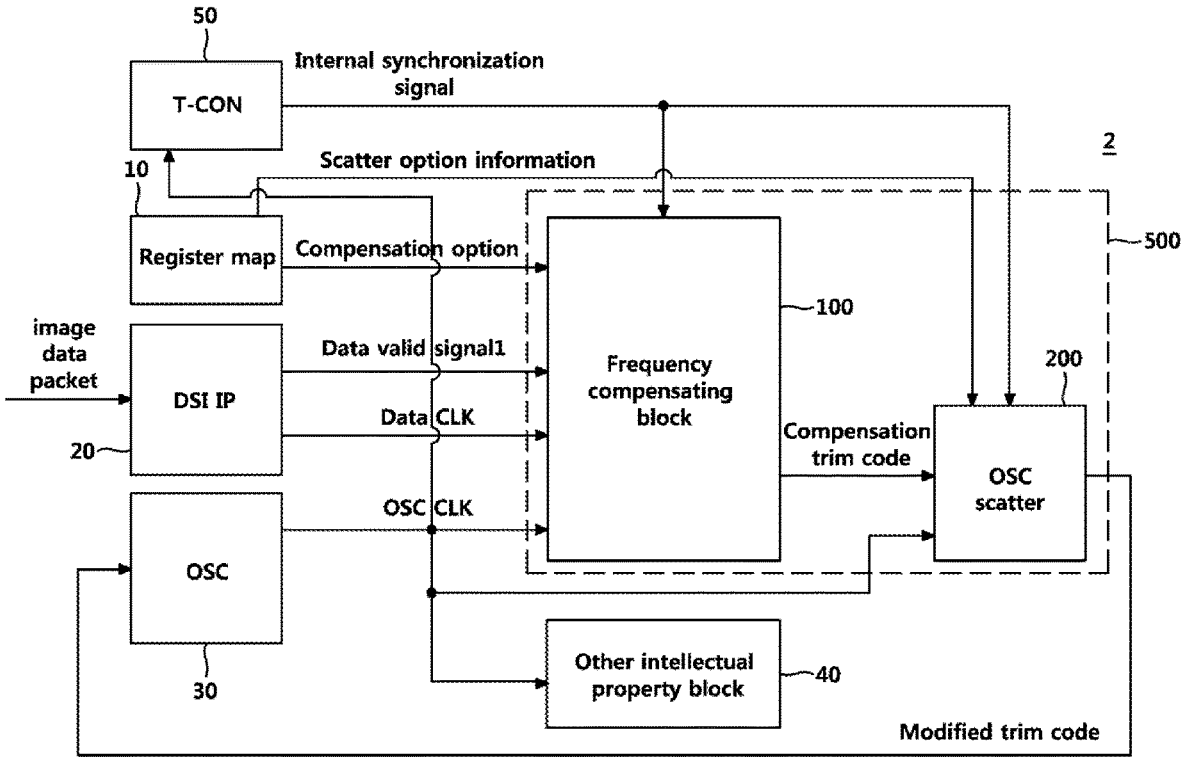
FIG. 11 is a block diagram illustrating an example of a display driver IC including an oscillator frequency controller in accordance with one or more embodiments.

FIG. 11 is a block diagram illustrating an example of a display driver IC including an oscillator frequency controller. For the convenience of description, the difference from FIG. 1 will be mainly described.

Referring to FIG. 11, a display driver IC 2 may include a register map 10, a DSI block 20, an oscillator 30, an intellectual property (IP) block 40, a timing controller 50, and an oscillator frequency controller 500.

The register map 10 stores a trim code which is a foundation to generate an operating frequency, information on a display panel (for example, a resolution or window size), compensation information (for example, a data clock periodic value, a target periodic value, and a changed cycle option), a compensation option (for example, a step adjusting option, a threshold value setting option, a reference code selecting option, and an internal synchronization selecting option), and scatter option information.

The timing controller 50 may generate an internal synchronization signal. The internal synchronization signal may include a vsync signal and a hsync signal.

The oscillator 30 may generate an oscillator clock OSC CLK in accordance with the trim code. The trim code is information on an operating frequency for driving the display panel. For example, the trim code may be expressed by a complementary number of 2.

The intellectual property (IP) block 40 performs a predetermined function based on the oscillator clock OSC CLK received from the oscillator 30.

The DSI block 20 receives image data packet from a host, and outputs a first data valid signal (Data valid signal1) and a data clock (CLK).

When the operating frequency is deviated from the target frequency in accordance with application of the trim code received from the register map, due to factors such as the temperature change, the voltage change, and the process change in accordance with the driving of the display, the oscillator frequency controller may periodically apply ±offset to the trim code compensated for noise spectrum scattering within a predetermined range while performing a frequency compensating operation to be operated at the target frequency again. The oscillator frequency controller 500 may include a frequency compensating block 100 and an oscillator scatter 200.

When the operating frequency in accordance with the trim code received from the register map 10 is deviated from the target frequency, the frequency compensating block 100 compensates for the operating frequency with the target frequency again. To be more specific, when the first data valid signal is activated by receiving the image data packet, the frequency compensating block 100 compares the current operating frequency, that is, a periodic value of the oscillator clock signal with a target periodic value and generates a compensation trim code in accordance with the comparison result and the selected compensation option. The compensation option includes a step adjusting option, a threshold value setting option, and a reference code selecting option (=current code selecting option).

The oscillator scatter 200 may receive the compensation trim code from the frequency compensating block 100, and generate a modified trim code obtained by periodically applying ±offset within a range specified with respect to the compensation trim code, based on the scatter option information received from the register map 10, the internal synchronization signal received from the timing controller 50, and the oscillator clock, and output the modified trim code to the oscillator 30.

Figure 12:
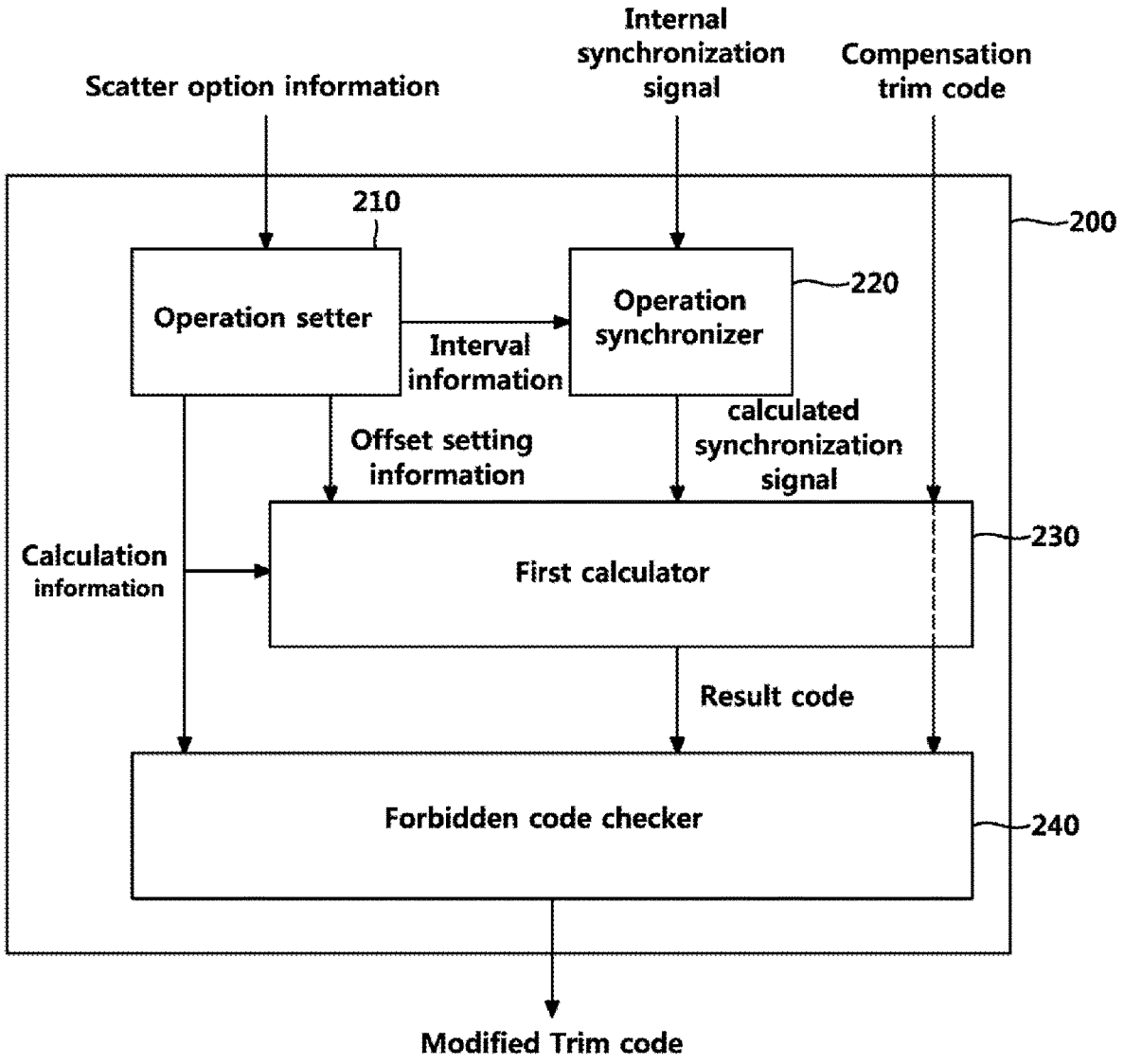
FIG. 12 is a block diagram illustrating an example of an oscillator scatter illustrated in FIG.

FIG. 12 is a block diagram illustrating an example of an oscillator scatter 200 illustrated in FIG. 11.

Referring to FIG. 12, according to an example, the oscillator scatter 200 may include an operation setter 210, an operation synchronizer 220, a first calculator 230, and a forbidden code checker 240.

The operation setter 210 selects a calculating method based on the scatter option information, and sets offset setting information for a size or an interval. The operation setter 210 transmits the interval information set in accordance with the scatter option information to the operation synchronizer 220. The operation setter 210 transmits calculation information to the forbidden code checker, and transmits calculation information and offset setting information set in accordance with the scatter option information to the first calculator 230.

That is, the operation synchronizer 220 generates the calculated synchronization signal by increasing or decreasing a cycle of the internal synchronization signal received from the timing controller 50 as a basic unit by n times in accordance with the interval information received from the operation setter 210. The multiplication information (n times) may include integer part and fractional part information.

For example, it is assumed that the multiplication information is 3 bits and an integer part is set to be 2 bits and a fractional part is set to be 1 bit. That is, it is assumed that two upper bits are the integer part and one lower bit is the fractional part.

When the multiplication information is 000, n=0 and the operation synchronizer 220 uses the internal counter, independently from the internal synchronization signal. If the multiplication information is 001, n=0.5 and the operation synchronizer 220 generates the operation synchronization signal as 0.5 times of cycle of the selected internal synchronization signal. If the multiplication information is 010, n=1 and the operation synchronization signal is generated to have the same cycle as the selected internal synchronization signal. If the multiplication information is 011, n=1.5 and the operation synchronization signal is generated to have 1.5 times of cycle of the selected internal synchronization signal. If the multiplication information is 100, n=2 and the operation synchronization signal is generated to have 2 times of cycle of the selected internal synchronization signal. With respect to the remaining bit values, the operation synchronization signal is generated with the cycle which is increased by n times.

For the convenience of description, even though the multiplication information is described as 3 bits, the examples are not limited thereto and it is obvious to those skilled in the art that the bit number or the setting of the integer part and the fractional part for the multiplication information may vary depending on the setting.

The first calculator 230 may calculate the trim code received from the register map 10 in accordance with the calculated synchronization signal, the calculation information received from the operation setter 210, and the offset setting information to generate a result code to which offset is applied. The first calculator 230 may vary the offset in accordance with the scatter option information and generate the result code to which the offset is applied, based on the calculated synchronization signal.

When it is determined that the result code is normal based on the calculation information, the first calculator 230 selects the result code as a modified trim code to output the result code. When it is determined that the result code is abnormal based on the calculation information, for example, if an overflow occurs, the result code is limited to a positive upper limit and if underflow occurs, the result code is limited to a negative lower limit.

The oscillator scatter 200 may further include the forbidden code checker 240 according to another example.

When the result code corresponds to a forbidden code, the forbidden code checker 240 converts the result code into an available adjacent modified trim code and outputs the converted code. The forbidden code is a trim code area which is not used in accordance with the implementation of the oscillator 30 and needs to be avoided at the time of operating the oscillator. For example, when the trim code is 8 bits, a total of 256 trim codes may be included. In accordance with a setting of the display driver IC 2, when only 156 trim codes are available, the remaining 100 trim codes correspond to forbidden codes.

Figure 13A:
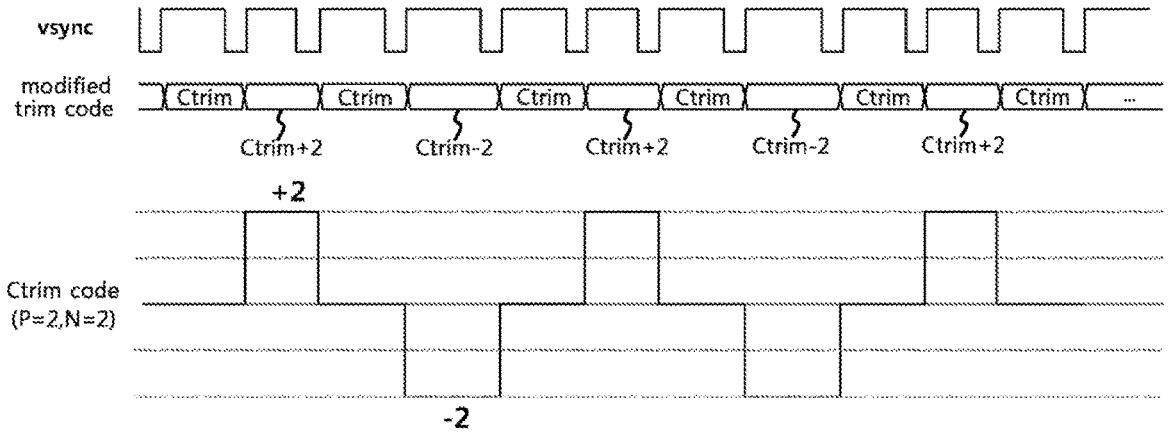
FIGS. 13A and 13B are timing charts illustrating an operation of an oscillator scatter illustrated in FIG. 11.
Figure 13B:
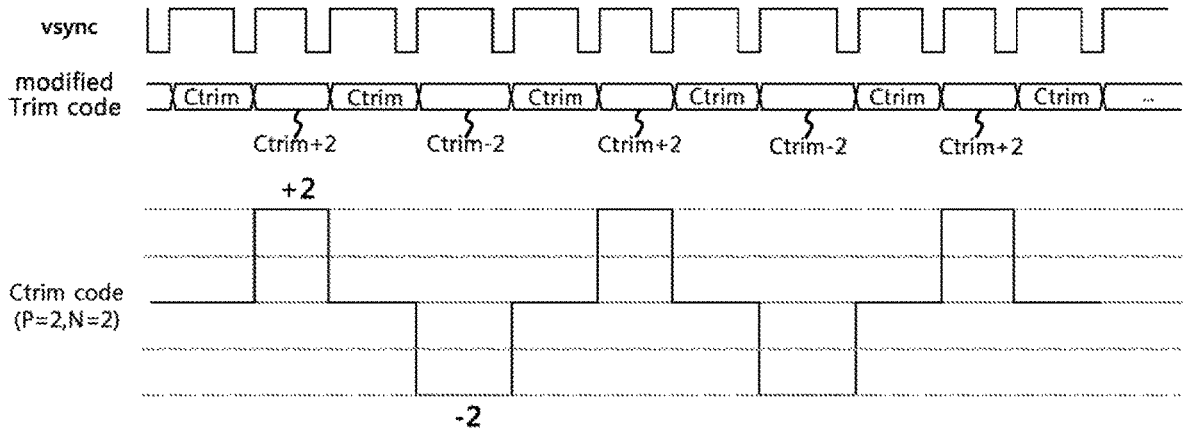

FIGS. 13A and 13B are timing charts which illustrate examples of an operation of an oscillator scatter illustrated in FIG. 11.

Referring to FIG. 13, the oscillator scatter 200 is synchronized with at least one of a horizontal synchronization signal and a vertical synchronization signal which are internal synchronization signals or synchronization signals generated at a predetermined interval by the counter setting to generate a modified trim code obtained by applying an offset to a compensation trim code Ctrim. In this example, the operation setter 210 may independently set a magnitude of the positive offset and a magnitude of the negative offset in accordance with the scatter option information.

As illustrated in FIG. 13A, the oscillator scatter 200 is synchronized with the horizontal synchronization signal to generate a modified trim code (Ctrim (P=2 and N=2)) in which the positive offset (P=2) and the negative offset (N=2) are alternately generated, by applying a scatter option information received from the register map 10.

Alternatively, as illustrated in FIG. 13B, the oscillator scatter 10->200 is synchronized with the vertical synchronization signal vsync to generate a modified trim code (Ctrim (P=2 and N=2)) in which the positive offset (P=2) and the negative offset (N=2) are alternately generated, by applying a scatter option information received from the register map 10.

That is, according to an example, the modified trim code may have a shape in which a positive offset and a negative offset are alternately generated with respect to the compensation trim code. Although not illustrated in FIGS. 13A and 13B, according to another example, the modified trim code may be a code in which the positive offset is periodically generated with respect to the modified trim code, and according to still another example, the modified trim code may be a code in which the negative offset is periodically generated with respect to the modified trim code. According to still another example, the modified trim code may be a code in which the positive offset and the negative offset are independently set to be alternately generated as offsets having different magnitudes. A number of repetitions may be specified with a synchronization signal selected for three sections including a section in which the positive offset is applied, a section in which the negative offset is applied, and a section in which no offset is applied (offset is 0) as a unit.

Figure 14A:
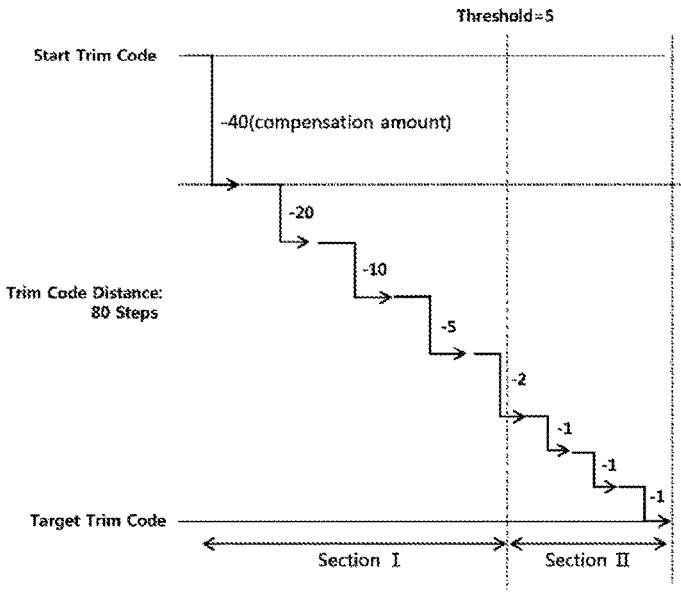
FIGS. 14A and 14B are conceptual views illustrating an operation of a frequency controller of FIG. 11 in accordance with one or more embodiments.
Figure 14B:
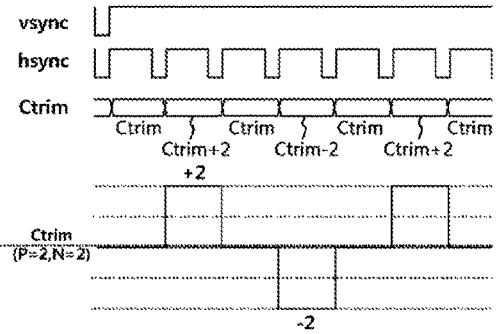
Figure 15A:
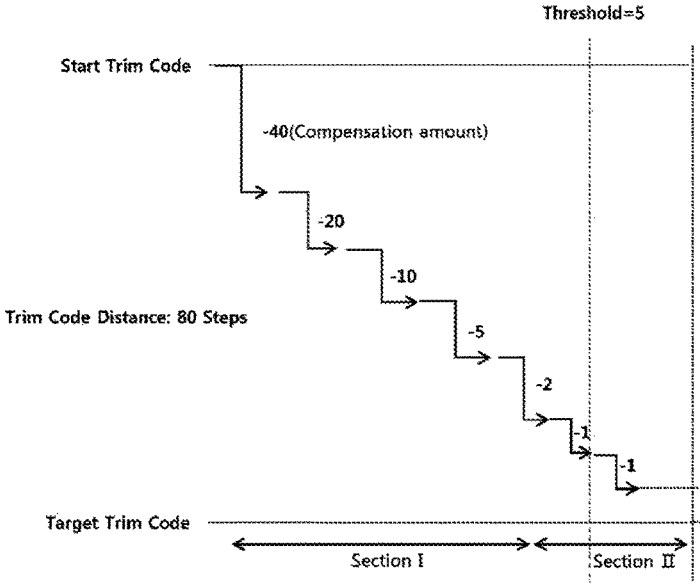
FIGS. 15A and 15B are conceptual views illustrating an operation of a frequency controller of FIG. 11 in accordance with one or more embodiments.
Figure 15B:
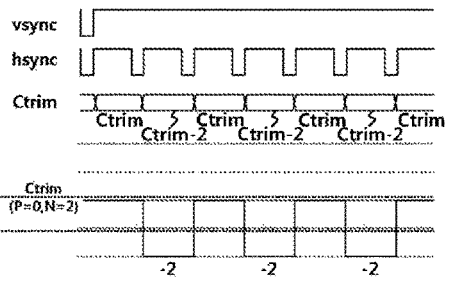

FIGS. 14A and 14B are conceptual views illustrating an operation of a frequency controller of FIG. 11 and FIGS. 15A and 15B are conceptual views illustrating an operation of a frequency controller of FIG. 11.

It is assumed that the compensating direction between the trim code (start trim code) of the calculated oscillator clock and a trim code (target trim code) in accordance with the target frequency, that is, the result sign value is a negative and the current step distance is 80 steps. It is assumed that the threshold value is 5 steps.

Referring to FIG. 14A, in the example of a Section I in which the step distance (80 steps) is larger than a predetermined threshold value (5 steps), the adjusted step may be set to be a value obtained by dividing the step distance into two, in accordance with the step adjusting option. As illustrated in FIG. 14A, when the adjusted step is compensated in a negative direction by 40 steps which is half the step distance (80 steps) due to the image data packet update, the step distance is reduced to 40 steps. Next, the adjusted step is compensated by a half 40 steps which is the remaining step distance value, that is, 20 steps, in a negative direction, due to the image data packet update. After applying the compensation, the step distance is reduced to 20 steps. Similarly, if it reaches a Section II in which the step distance is smaller than the threshold value while sequentially performing compensating in the same way, the adjusted step is changed to be compensated in a negative direction by a unit step which is 1. When this process is repeated, the compensation trim code which is cumulatively compensated as much as the adjusted step from the current trim code or the start trim code due to the image data packet update may converge and reach the target trim code.

The oscillator scatter 200 periodically applies ±offset within a range specified with respect to the compensation trim code by applying the offset to the compensation trim code to vary the frequency. The compensation trim code compensated as much as the adjusted step is input to the oscillator scatter 200 to be calculated as a modified trim code in accordance with the offset setting in accordance with the scatter option information.

Referring to FIG. 14B, in the scatter option information, the positive offset and the negative offset are alternately cancelled and an average value of the modified trim code becomes a compensation trim code.

Further, the oscillator scatter applies ±offset to cancel the positive offset and the negative offset with each other. However, due to the actual implementation characteristics of the oscillator, in some examples, the frequency variation between adjacent codes of the entire trim code may not be constant. Therefore, although ±offset with the same magnitude is designated, the positive offset and the negative offset may not be cancelled with each other in some examples. In this example, when the frequency compensating block is used, a compensation trim code which may cancel ±offset by the oscillator scatter may be generated.

Referring to FIGS. 15A and 15B, in order to illustrate an example in which the ±offset cannot be cancelled, the negative offset is periodically generated with respect to the compensation trim code. It is illustrated that the frequency compensating block identifies the average frequency by the negative offset of the oscillator scatter to perform the compensation, and converges on the target trim code by erroneous aiming in the frequency compensating block. The display driver IC including an oscillator frequency controller as described above may operate at a target frequency insensitive to the temperature change, the voltage change, or the process change in accordance with the operation.

Further, when the oscillator scatter which applies ±offset within a range specified with respect to the compensation code to periodically vary the frequency is used together, not only the frequency is compensated, but also the noise spectrum may be scattered and the EMI peak value may be reduced.

The display driver IC including a frequency compensating block and an oscillator scatter of the examples may be insensitive to factors such as the temperature, voltage, and process change by the oscillator frequency compensation, and may reduce the EMI peak value by the oscillator so that a signal quality of the mobile electronic apparatus may not be deteriorated.

The display driver IC of the examples may perform a dynamic compensating operation in an oscillator frequency compensating block to operate and be maintained at a target frequency that is insensitive to factors such as the temperature change, the voltage change, or the process change.

The display driver IC of the examples may periodically change the operating frequency in the oscillator scatter to scatter the noise spectrum. Further, the display driver IC of the examples may reduce an EMI peak value by scattering the noise spectrum of the internal oscillator.

The display driver IC including a frequency compensating block and an oscillator scatter of the examples may maintain a target frequency of the oscillator by the dynamic compensating operation with respect to the change in the surrounding environment (temperature and voltage), and may reduce the EMI peak value by scattering the noise spectrum so that the signal quality of the mobile electronic apparatus is not deteriorated.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A display driver Integrated Circuit (IC), comprising:

a register map configured to store a trim code, a window size, compensation information, and a compensation option;

an oscillator configured to generate an oscillator clock based on the trim code;

a timing controller configured to generate an internal synchronization signal based on the generated first oscillator clock;

a Display Serial Interface (DSI) block configured to output a first data valid signal which is activated based on a data clock and an image data packet update; and a frequency compensating block configured to compare a periodic value of the oscillator clock with a target periodic value, and generate a compensation trim code obtained by compensating the trim code in accordance with a result of the comparing and the compensation option, in accordance with the first data valid signal, wherein the periodic value is calculated from the data clock and the internal synchronization signal, and wherein the oscillator is configured to output a compensation oscillator clock in accordance with the compensation trim code.

2. The display driver IC of claim 1, wherein the frequency compensating block comprises:

a clock counter configured to receive the window size and count the data clock and the number of oscillator clocks based on the first data valid signal;

a Finite State Machine (FSM) configured to be synchronized with the internal synchronization signal to output a first control signal and a second control signal based on a predetermined state, and perform the frequency compensating operation;

a second calculator configured to calculate a periodic value of the oscillator clock based on the window size, the periodic value of the data clock, and the number of oscillator clocks when the first control signal is received; and a compensation processor configured to generate the compensation trim code based on a compensating direction and a compensation option determined by comparing the periodic value of the oscillator clock with the target periodic value, and configured to apply the compensation trim code to the oscillator when the second control signal is received.

3. The display driver IC of claim 2, wherein:

the compensation information comprises the periodic value of the data clock, the target periodic value, and a changed periodic value, and the compensation option comprises a step adjusting option, a threshold value setting option, an internal synchronization selecting option, and a current code selecting option.

4. The display driver IC of claim 2, wherein the clock counter comprises:

a clock domain crossing (CDC) synchronizer configured to generate a second data valid signal obtained by synchronizing the first data valid signal with the oscillator clock;

an oscillator clock counter configured to count the number of oscillator clocks based on the second data valid signal;

a reference data clock counter configured to count a number of data clocks for the first data valid signal to calculate a number of input pixels;

a window update size confirmer configured to compare the number of input pixels with the window size to output the number of data clocks and a result of the comparing; and a count output performer configured to output a first update completion signal in accordance with the result of the comparing and output the number of data clocks and the number of oscillator clocks.

5. The display driver IC of claim 2, wherein states of the FSM comprises:

an idle state in which the frequency compensating operation is disabled;

a wait state that waits for the image data packet update to be completed;

a ready state in which when the image data packet update is completed, the FSM is synchronized with the internal synchronization signal;

a calculating state in which the FSM is synchronized with the internal synchronization signal to perform the frequency compensating operation; and an apply state which applies the compensation trim code to be synchronized with the internal synchronization signal to the oscillator, and stabilizes the compensation trim code, and wherein the FSM is configured to output the first and second control signals based on the states of the FSM.

6. The display driver IC of claim 5, wherein the FSM is synchronized with a vertical synchronization signal to apply the compensation trim code to the oscillator when the state changes from the calculating state to the apply state; and wherein the FSM is synchronized with a next vertical synchronization signal to enter the wait state for a next frequency compensating operation when the state changes from the apply state to the wait state.

7. The display driver IC of claim 5, wherein the FSM is synchronized with a horizontal synchronization signal to apply the compensation trim code to the oscillator when the state changes from the calculating state to the apply state; and wherein the FSM is configured to be synchronized with a next vertical synchronization signal to enter the wait state for a next frequency compensating operation when the state changes from the apply state to the wait state.

8. The display driver IC of claim 5, wherein the FSM is configured to be synchronized with a vertical synchronization signal to apply the compensation trim code to the oscillator when the state changes from the calculating state to the apply state; and wherein the FSM is configured to be synchronized with a next horizontal synchronization signal to enter the wait state for a next frequency compensating operation when the state changes from the apply state to the wait state.

9. The display driver IC of claim 5, wherein the FSM is configured to be synchronized with a horizontal synchronization signal to apply the compensation trim code to the oscillator when the state changes from the calculating state to the apply state; and wherein the FSM is configured to be synchronized with a next horizontal synchronization signal to enter the wait state for a next frequency compensating operation when the state changes from the apply state to the wait state.

10. The display driver IC of claim 2, wherein the compensation processor comprises:

a step distance calculator configured to output a difference, a result sign value, and a zero-result value by comparing the periodic value of the oscillator clock and the target periodic value, and calculate a number of steps in accordance with the difference, based on a changed periodic value;

a code step adjuster configured to determine an adjusted step based on the number of steps and the compensation option;

a reference code selector configured to select one of the trim code and the compensation trim code as a reference code based on the compensation option; and a compensation code calculator configured to apply the adjusted step to the reference code to generate a result code.

11. The display driver IC of claim 10, wherein the compensation processor further comprises:

a forbidden code checker configured to output the result code based on the result sign value and the zero-result value when the second control signal is received, and output an available adjacent result code when the result code is a forbidden code.

12. The display driver IC of claim 10, wherein if a step adjusting option is zero, the code step adjuster determines a unit step as an adjusted step and if a step adjusting step is not zero, the number of steps is determined as the adjusted step based on a predetermined table, and when the number of steps is smaller than a threshold value, the unit step is determined as the adjusted step.

13. The display driver IC of claim 11, wherein the forbidden code checker is configured to transmit a feedback to the oscillator to maintain a current trim code if the difference is the zero result value, and output the result code selected in accordance with the result sign value if the difference is not the zero result value.

14. The display driver IC of claim 12, wherein when the step adjusting option is not zero, the step adjusting option determines a value obtained by dividing the number of steps into N (N is a natural number) as the adjusted step.

15. A method of adjusting an operating frequency of a display driver integrated circuit (IC), the method comprising:

generating, by an oscillator, an oscillator clock based on a trim code;

receiving a first data valid signal which is activated based on a data clock and an image data packet update;

confirming a result sign value by comparing a periodic value of the oscillator clock that is calculated based on a window size and an internal synchronization signal with a target periodic value that is based on the first data valid signal and calculating a difference between the periodic value of the oscillator clock and the target periodic value;

determining an adjusted step based on a step adjusting option and a threshold value setting; and updating a result code obtained by applying the determined adjusted step to a reference code, and outputting the result code to the oscillator as a compensation trim code.

16. The method of claim 15, wherein the confirming comprises:

generating a second data valid signal obtained by synchronizing the first data valid signal with the oscillator clock;

counting a number of oscillator clocks for the second data valid signal and a number of data clocks for the first data valid signal; and confirming that the image data packet update is completed when the number of data clocks is equal to the window size.

17. The method of claim 15, wherein the calculating comprises:

outputting a first control signal and a second control signal by changing to any one of an idle state, a wait state, a ready state, a calculating state, and an apply state by synchronizing a Finite State Machine (FSM) with the internal synchronization signal;

calculating a periodic value of the oscillator clock based on a periodic value of the data clock, the window size, and the number of oscillator clocks based on the first control signal;

calculating the result sign value and the difference by comparing the calculated periodic value of the oscillator clock and the target periodic value;

generating the compensation trim code based on the result sign value and a compensation option; and outputting the compensation trim code to be reflected to the oscillator when the second control signal is received.

18. The method of claim 17, wherein in the outputting of the second control signal, when the state changes from the calculating state to the apply state, the compensation trim code is applied to the oscillator by being synchronized with a vertical synchronization signal, and when the state changes from the apply state to the wait state, the wait state is for a next frequency compensating operation to be synchronized with a next vertical synchronization signal.

19. The method of claim 17, wherein in the outputting of the second control signal, when the state changes from the calculating state to the apply state, the compensation trim code is applied to the oscillator by being synchronized with a horizontal synchronization signal and when the state changes from the apply state to the wait state, the wait state is for a next frequency compensating operation to be synchronized with a next vertical synchronization signal.

20. The method of claim 17, wherein in the outputting of the second control signal, when the state changes from the calculating state to the apply state, the compensation trim code is applied to the oscillator by being synchronized with the vertical synchronization signal and when the state changes from the apply state to the wait state, the wait state is for a next frequency compensating operation to be synchronized with a next horizontal synchronization signal.

21. The method of claim 17, wherein in the outputting of the second control signal, when the state changes from the calculating state to the apply state, the compensation trim code is applied to the oscillator by being synchronized with a horizontal synchronization signal and when the state changes from the apply state to the wait state, the wait state is for a next frequency compensating operation to be synchronized with a next horizontal synchronization signal.

22. The method of claim 15, wherein in the determining of an adjusted step, when a step adjusting option is zero, a unit step is determined as the adjusted step, when the step adjusting option is not zero, the number of steps is determined as the adjusted step based on a predetermined table and when the number of steps is smaller than a threshold value, the unit step is determined as the adjusted step.

23. The method of claim 15, wherein as the reference code, one of the trim code and the compensation trim code is selected in accordance with a reference code selecting option.

24. The method of claim 15, wherein in the outputting of the compensation trim code to the oscillator, when the result code is not a forbidden code, the result code is output as the compensation trim code, when the difference is a zero result value, the reference code is output as the compensation trim code, and when the result code is the forbidden code, an available adjacent result code is output as the compensation trim code.

25. The method of claim 15, further comprising:

calculating an offset based on the internal synchronization signal, a scatter option information, and the oscillator clock; and generating a modified trim code obtained by applying the offset to the compensation trim code to output the modified trim code to the oscillator.

26. The method of claim 25, wherein the calculating the offset comprises:

selecting a calculating method based on the scatter option information and setting a magnitude of the offset and interval information; and adjusting the internal synchronization signal to a calculated synchronization signal based on the interval information and the oscillator clock.

* * * * *